United States Patent [19]

Paris

[11] Patent Number: 4,593,483

[45] Date of Patent: Jun. 10, 1986

[54] TIGHTENING AND CLOSURE APPARATUS FOR SKI BOOT

[75] Inventor: Jean Paris, Sevrier, France

[73] Assignee: Salomon S.A., Annecy, France

[21] Appl. No.: 555,555

[22] Filed: Nov. 28, 1983

[30] Foreign Application Priority Data

Dec. 2, 1982 [FR] France ..... 82 20887
Oct. 12, 1983 [FR] France ..... 83 16589

[51] Int. Cl.[4] ..... A43B 5/04; A43B 11/00

[52] U.S. Cl. ..... 36/119; 36/50; 24/68 SK

[58] Field of Search ..... 36/117-121, 36/105, 50; 24/68 SK, 69 SK, 70 SK, 71 SK

[56] References Cited

U.S. PATENT DOCUMENTS 3,545,106 12/1970 Martin .
3,975,838 8/1976 Martin .
4,426,796 1/1984 Spademan ..... 36/119

FOREIGN PATENT DOCUMENTS 0015862 9/1980 European Pat. Off. ..... 36/117
0053340 6/1982 European Pat. Off. ..... 36/120
2317408 10/1973 Fed. Rep. of Germany .
3201702 9/1982 Fed. Rep. of Germany ..... 36/119
3236259 4/1983 Fed. Rep. of Germany ..... 36/120
1115248 4/1956 France .
1408646 7/1965 France .
1568397 5/1969 France .
2275166 1/1976 France .
2345097 10/1977 France .
2371896 6/1978 France ..... 36/120
2407681 6/1979 France .
WO81/01949 7/1981 PCT Int'l Appl. .
WO82/02479 8/1982 PCT Int'l Appl. .

*Primary Examiner*—James Kee Chi
*Attorney, Agent, or Firm*—Sandler & Greenblum

[57] ABSTRACT

A rear entry ski boot formed of an upper having a cuff and a rear spoiler. At least a portion of the upper is journalled on a shell base along a generally transverse axis. The boot further includes a foot retention apparatus within the shell base; and a closure apparatus for closing the upper around the lower leg of the skier. The closure apparatus is connected to the foot retention apparatus by means of a traction circuit.

37 Claims, 9 Drawing Figures

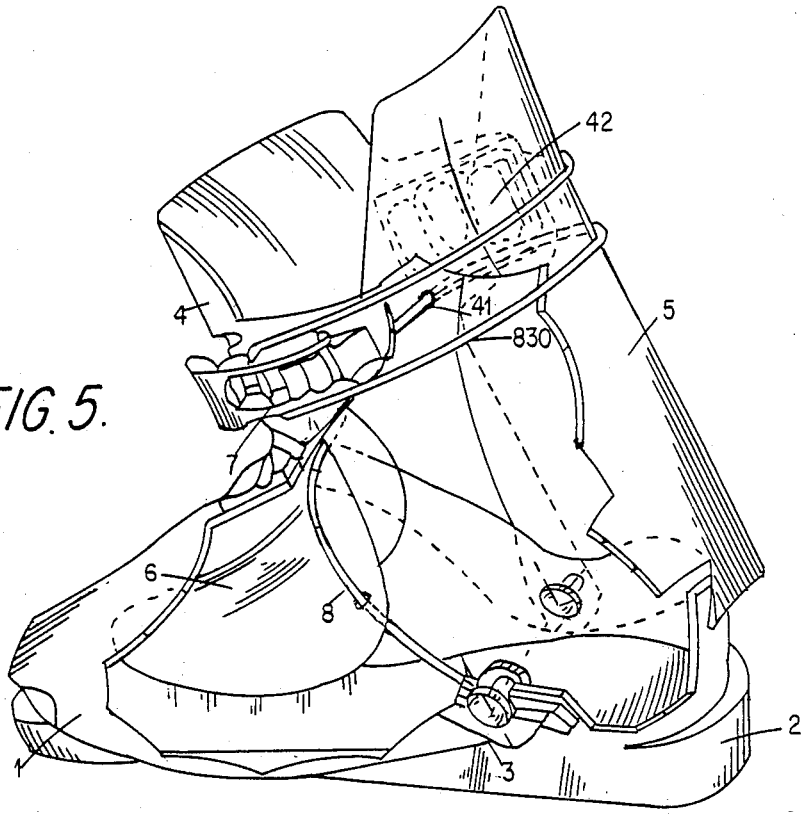
FIG. 5.
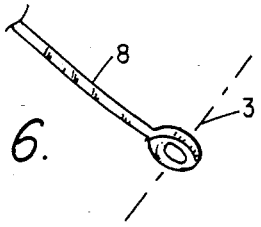
FIG. 6.
FIG. 7.
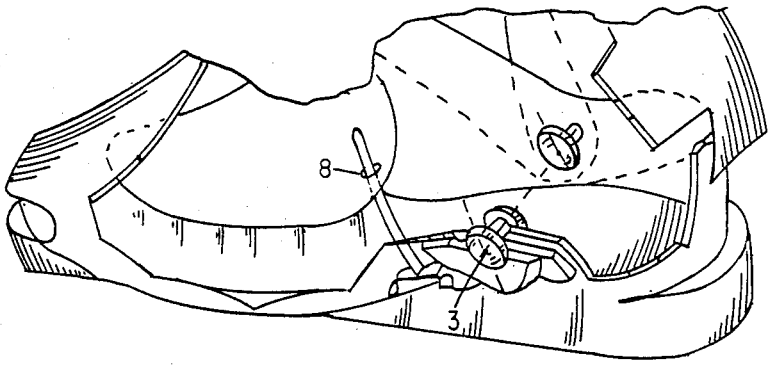

TIGHTENING AND CLOSURE APPARATUS FOR SKI BOOT

BACKGROUND OF THE INVENTION

1. Field of the Invention

The present invention relates to ski boots having a rigid shell base, and which preferably allow for insertion of the foot from the rear, i.e., rear entry boots. More particularly, the invention relates to an apparatus for tightly holding down the foot within the shell base and tightly enclosing the upper around the leg of the skier.

2. Description of Prior Art

Known ski boots comprise a rigid shell base on which an upper is journalled, at least in part, around a horizontal axis. The upper is generally composed of a rear spoiler and a cuff. The upper and the shell base contain an interior sock. The rear spoiler is itself journalled around a transverse horizontal axis connected to the upper or to the rigid shell base in a manner so as to be able to pivot rearwardly to allow for the introduction of the foot into the boot (actually the sock) from the rear in a forward movement.

For the insertion of the foot to occur in a manner which allows for efficient and proper skiing, as well as for the comfort of the skier, two essential functions must be assured. First, the heel of the skier must be blocked in position, and the foot must be held down in the boot by an interior tightening or hold-down means. Secondly, the upper must enclose the bottom of the skier's leg by securing the rear spoiler to the cuff. Often, at least to a certain extent, according to the state of the art, these two functions are achieved independently of one another, each by means of independent and distinct manipulation elements.

Thus, in German Patent No. A1 2 317 408, the tightening and hold down of the lower portion of the foot occurs by adjusting the closure of a front cuff which is journalled around a transverse axis of the shell base (not rigid in this case) or its equivalent, by means of a traction cable whose one end is connected to the front cuff. The enclosure and tightening around the lower portion of the leg are effected by pivoting a rear spoiler shut, which at the same time adds to the tension of the traction cable. The rear spoiler is secured onto the cuff by means of a conventional hooking closure apparatus.

In French Pat. No. 2,345,097, the hold down of the foot in the rigid shell base is achieved by a support element which is biased by a traction cable whose one end is integral with the rear spoiler by means of a pinion adjustment system. The closure of the shell base is performed by likewise acting on the tension of the cable in a fashion similar to that of the preceding case.

French Pat. No. 2,275,166 discloses a boot having a front insertion opening and lateral tightening flaps forming an open upper which is thus not of the rear insertion type. The holding down of the foot and the closure of the lateral flaps are effected by means of a traction element passing through guide elements and extending in an alternating manner from one side to the other of the opening separating the flaps. The end of the traction element is connected to a flap closure apparatus between the two flaps. The closure of the shell base around the lower leg is performed by a distinct and independent element which draws together the rear spoiler and the open upper constituted by the tightening flaps.

French Pat. No. 1,568,397 is very similar to the previous French patent in that it describes a conventional ski boot having flaps, and a hold down and flap closure apparatus, using a cable sliding within a sleeve. A boot is thus provided having an opening on the top of the foot, with front insertion, without rear spoiler nor cuff. The boot disclosed, therefore, does not provide means for the tight hold down of the foot in a rigid shell and the enclosure of the lower leg by an upper composed of a rear spoiler and a cuff.

French Pat. No. 1,408,646 likewise proposes a closure for a conventional ski boot having the usual flaps. In addition to the fact that the boot has a front insertion opening and does not have a journalled upper, the hold down of the foot occurs by a plurality of exterior traction cables cooperating with latch hooks, and the enclosure of the lower foot itself is accomplished by a similar and totally distinct and independent apparatus from the preceeding.

French Pat. No. 1,115,248 proposes a solution which is very similar to the preceding approach. However, in this solution a single manipulation element serves two functions. Yet, because the boot is not a boot having a rigid shell base with an upper having a cuff and a rear spoiler allowing for rear entry, the problems of tightly holding down the foot and enclosure of the upper around the lower portion of the foot do not really occur, and it cannot really be said that two functions are actually being accomplished. The proposed solution can thus not be seriously considered with boots of the type contemplated in the instant invention. The problem which is resolved by the boot of this patent is instead that of a city boot having an upper.

As can be seen from the state of the art as it appears from the above patents, the functions of holding down the foot to wedge the heel in the shell, and the enclosure of the bottom of the leg are not achieved by a single element having a single manipulation element in a rear entry ski boot with a rigid shell base and an upper having a cuff and a rear spoiler at least partially journalled on the shell base.

DESCRIPTION OF PREFERRED EMBODIMENTS

It is, therefore, an object of the invention to provide a rear entry ski boot formed of an upper comprising a cuff and a rear spoiler. At least a portion of the upper is journalled on a shell base along a generally transverse axis. The boot further includes a foot retention apparatus within the shell base; and a closure apparatus for closing the upper around the lower leg of the skier. The closure apparatus is connected to the foot retention apparatus by means of a traction circuit.

The traction circuit is preferably a single traction circuit adapted to both assure retention of the rear spoiler against the cuff during rearward lean, and hold down the instep.

In one embodiment the single traction circuit preferably is formed of a single cable having a portion which at least partially surrounds the rear of the boot in the vicinity of the lower leg. The single traction cable forms a closed loop having a lower semi-loop extending around and over the instep of the skier, and which then extends upwardly in two portions behind the heal of the skier and rises up the rear spoiler to end in two upper lateral opposite semi-loops. Each of said semi-loops is connected by a common portion. The two semi-loops end, respectively, in at least one lateral anchorage element on the cuff, and at least one latching element cooperating with a complimentary element carried by the cuff at the level of the lower leg of the skier.

In this embodiment, each of the two portions extending from the lower semi-loop passes adjacent to the transverse axis, before turning to extend upwardly behind the heel. Each of the two portions at the end of the lower semi-loop turn to extend upwardly and passes into a fixed guide behind the heel on said rear spoiler. At the lower portion of the leg, the portions extending up the rear spoiler each pass out to the exterior through a fixed guide on the upper portion of the rear spoiler.

One of the upper lateral semi-loops may cooperate with an anchorage apparatus on the cuff and the other of the semi-loops may be associated with a latching element cooperating with a complimentary element on the cuff.

According to aspect of the invention the single traction circuit comprises a traction cable which forms a lower semi-loop passing over and around the instep of the skier before changing direction adjacent to the transverse axis and rising up the rear spoiler until a fixed guide. It then passes behind the rear spoiler to form an upper semi-loop associated with a latching element cooperating with a complimentary element on the cuff at the lower level of the leg and ends in a portion again passing behind the rear spoiler. It is ultimately attached at its end to an anchorage apparatus on the cuff.

According to another embodiment of the invention the single traction circuit comprises a cable which forms a lower semi-loop passing over and around the instep of the skier before changing direction adjacent to the transverse axis. It then rises up the cuff until a fixed guide on the cuff where its direction is changed to then pass behind the rear spoiler to form an upper semi-loop associated with a latching element cooperating with a complimentary element on the cuff at the lower level of the leg. The cable then passes behind the rear spoiler and is attached at its end to an anchorage apparatus on the cuff.

The foot retention apparatus may assume the form of a lower semi-loop adapted to extend over and around the instep of the skier. The apparatus may be a single traction cable, and a portion of the cable may form the lower semi-loop. In this instance the foot retention apparatus may further comprise an anatomically configured shell. The semi-loop is adapted to press the shell against the instep whereby the shell distributes pressure exerted by the semi-loop over the instep.

According to yet another embodiment the single traction circuit is formed of a cable connected at both its ends to a strap. The strap constitutes the foot retention apparatus, and extends over the instep to connect the lower ends of each of the cables. The strap distributes the contact pressure due to the traction of the cable on the instep of the skier.

In yet another embodiment the single traction circuit comprises a cable connected at one of its ends to a strap within the shell base and is secured at its end not attached to the cable to the shell base. The cable extends out of the shell base, and rises upwardly behind the rear spoiler before being secured at its other end to the cuff. Tensioning of the cable by closure of the closure apparatus presses the rear spoiler against the cuff, and holds down the foot by exerting pressure on the instep.

Following yet another embodiment the single traction circuit comprises a cable attached at a first end to the boot at a location adjacent to the transverse journal axis. The cable passes upwardly and across the instep of the skier and leaves to the exterior of the cuff through a fixed lateral guide in the cuff on the side opposite from the attachment point, at the level of the lower leg. The cable then forms a semi-loop associated with the closure apparatus to end in a lateral anchorage point on the cuff. The semi-loop between the fixed lateral guide and the anchorage point passes on the rear spoiler along a direction which is at least generally perpendicular to that of the leg of the skier. The anchorage point on the cuff is positioned on the same side as the fixed lateral guide. The fixed lateral guide may constitute a first fixed guide, and the cable, upon leaving the first fixed guide on said cuff, extends rearwardly along the rear spoiler to pass through a second fixed guide on the rear spoiler before forming a semi-loop on the dorsal portion of the rear spoiler extending below the lower leg and generally parallel to the axis of the leg. The cable then passes through a third fixed guide on the rear spoiler at the level of the lower leg, before extending frontwardly towards the cuff to an anchorage point positioned on the cuff. The anchorage point is positioned on the cuff on the side opposite the first fixed guide.

The first end of said cable may be adjustably or permanently anchored. When permanently anchored the first end of the cable comprises an eye therein anchored by a transverse axis pin.

In yet another embodiment the single traction circuit comprises a cable attached at a first end to the boot by means of a strap secured to the boot at a location adjacent to the transverse axis. The strap passes upwardly and across the instep of the skier whereat it is connected to the cable. The cable passes to the exterior of said cuff through a fixed lateral guide in the cuff, at the level of the lower leg, on the side opposite from the attachment point of the strap to the boot. It then forms a semi-loop associated with the closure apparatus to end in a lateral anchorage point on the cuff.

From another perspective, the invention relates to a rear entry ski boot comprising:

(a) an upper comprising two separable portions, at least one of the portions being journalled relative to the other;

(b) a foot retention apparatus within the boot for holding down a foot instep to maintain the heel tightly in the boot; and (c) a closure apparatus for closing the upper around the lower leg of the skier. The closure apparatus is connected to said foot retention apparatus by means of a single traction circuit, whereby exertion of tractional force on said circuit results in simultaneous hold down of the instep and increased tightening of the enclosure of the upper around the lower leg.

The single traction circuit is preferably rendered activatable by manipulation of a single latching element. Where the separable portions of the boot comprise a cuff and a rear spoiler, the latching element may be positioned on the cuff, the rear spoiler, or extends over the rear spoiler and cuff in the closed position.

BRIEF DESCRIPTION OF THE DRAWINGS

The invention will now be described with reference to the annexed drawings in which:

FIG. 5 is a side perspective view of yet another embodiment of the invention;

FIGS. 6 and 7 illustrate two ways of anchoring a single cable adjacent to the journal axis of the shell base;

DESCRIPTION OF PREFERRED EMBODIMENTS

Figure 1:
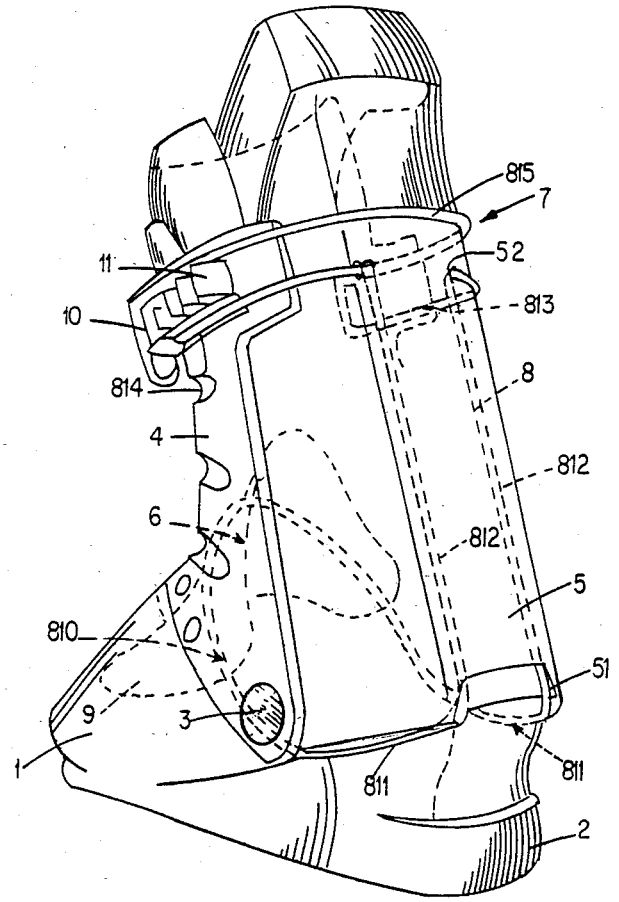
FIG. 1 illustrates a first embodiment of the invention in rear perspective.

In the description which follows the same reference numeral will be used to designate the same or similar elements.

The ski boots shown in the Figures comprise, in a conventional manner, a rigid shell base 1, having sole 2 on which is journalled around a transverse horizontal axis 3 an upper formed of a cuff 4 and a rear spoiler 5. Cuff 4 can be attached to shell base 1. In general, it is journalled so as to have a small degree of freedom of movement under stress. According to the invention it suffices that only the rear spoiler 5 be effectively journalled to allow for its rearward pivoting for the introduction of the foot of the skier into the boot (rear entry). Foot hold down or retention apparatus 6 is positioned within shell base 1, and the upper is provided at its upper portion corresponding to the lower leg of the skier with a closure apparatus designated generally as 7 which connects rear spoiler 5 to cuff 4 around the bottom of the leg.

According to the present invention, the apparatus for retention of foot 6 and the apparatus for the enclosure of lower leg 7, which must assure two distinct functions which are normally independent in principle, are connected by means of a single traction cable 8 which connects them.

In the embodiment of FIG. 1, cable 8 is in the form of a single closed loop. The loop passes over the instep of the skier where it presses against a shell 9 having an anatomical configuration to match the foot. It then passes adjacent to transverse axis 3 and preferably beneath it, before its two portions 811 separate from one another towards the heel in a fashion so as to form a semi-loop 810 which pulls on shell 9 to wedge the heel of the skier into the bottom of shell base 1. These two portions 811 which extend at this level, either on the interior, or the exterior of shell 3, if desired within a fixed protected sheath, arrive at the heel of shell base 3, and change direction by passing through fixed guides 51 carried by rear spoiler 5 to run, for example, parallel to one another, as indicated at 812, the length of the dorsal portion of rear spoiler 5 until the level of enclosure of the lower leg 7. At this location, portions 812 bifurcate into two opposite directions, which are approximately perpendicular to the general direction of cuff 4, thus to the direction of the orientation of the leg of the skier, while passing through guides 52 carried by rear spoiler 5 to form two semi-loops 813 and 814 on both sides of the upper whose upper respective portions 815 join one another behind or within rear spoiler 5 to close the overall loop formed by cable 8.

First upper semi-loops 813 cooperates in a known manner with a stud (not shown in the drawings) carried by cuff 4, by going around it. Preferably, a plurality of studs are provided which allow for an adjustment in length of semi-loop 813. The second upper semi-loop 814 carries at its end, i.e., its portion which is furthest spaced from rear spoiler 5, a latching element 10, for example in the form of a hook latch, cooperating with a complimentary element 11 attached to cuff 4 and which may have several successive pinions or uprights allowing for tightening adjustment. These two elements, together with semi-loops 813 and 814 connected by cable portion 815, constitute closure apparatus 7 of the upper around the lower leg of the skier which assures the retention of rear spoiler 5 when the skier is in a rear support position.

With the apparatus which has just been described, it is clear that the manipulation and closure of a single latching element 10 onto a complimentary element 11 carried by cuff 4 will at the same time pull on semi-loop 810 and thus assure the hold down of the foot by means of shell 9 by wedging the heel of the skier agains the bottom of shell base 1, and also assure the closure of the cuff around the lower leg of the skier. In a conventional manner, the adjustment force of traction cable 8, both for retention of the foot as well as for enclosure of the lower leg is controlled by adjusting the play on the studs on cuff 4 and cooperating with semi-loop 813 and/or pinions 11 cooperating with the hook or hooks of latching element 10.

Figure 2:
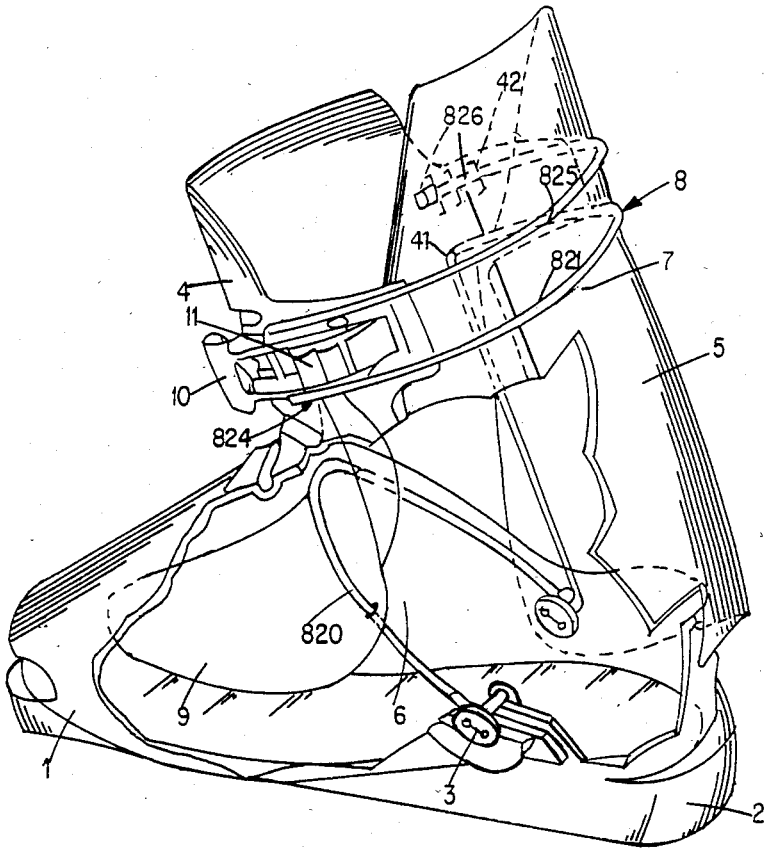
FIG. 2 illustrates a second embodiment of the invention in rear perspective.

In the embodiment of FIG. 2, single cable 8 does not form a closed loop but is, instead, fixed at each of its ends. A first end is positioned adjacent to the bore of transverse axis 3, or on the axis pin itself, on one side of the boot. Cable 8 thus describes a semi-loop 820 surrounding the top of the instep of the skier by ultimately cooperating with an anatomically configured shell 9, then passing again adjacent to the second lateral end of transverse axis 3 before rising the length of rear spoiler 5, or preferably, the length of cuff 4, until a fixed guide 41 at the level of the lower leg. From this fixed guide 41, cable 8 assumes an approximately perpendicular orientation to pass behind rear spoiler 5, as shown at 821, before forming a semi-loop 824 similar to semi-loop 814 (FIG. 1) and provided with the same elements 10, 11, allowing for the enclosure and length adjustment as in the first embodiment described above. Semi-loop 824 ends in a portion 825 parallel to portion 821, whose end is attached to cuff 4 at 826 by anchorage means 42, preferably having several positions, to provide a supplemental adjustment ability of the tension of cable 8 as in the case of the anchorage studs described in connection with the previous embodiment.

Figure 3:
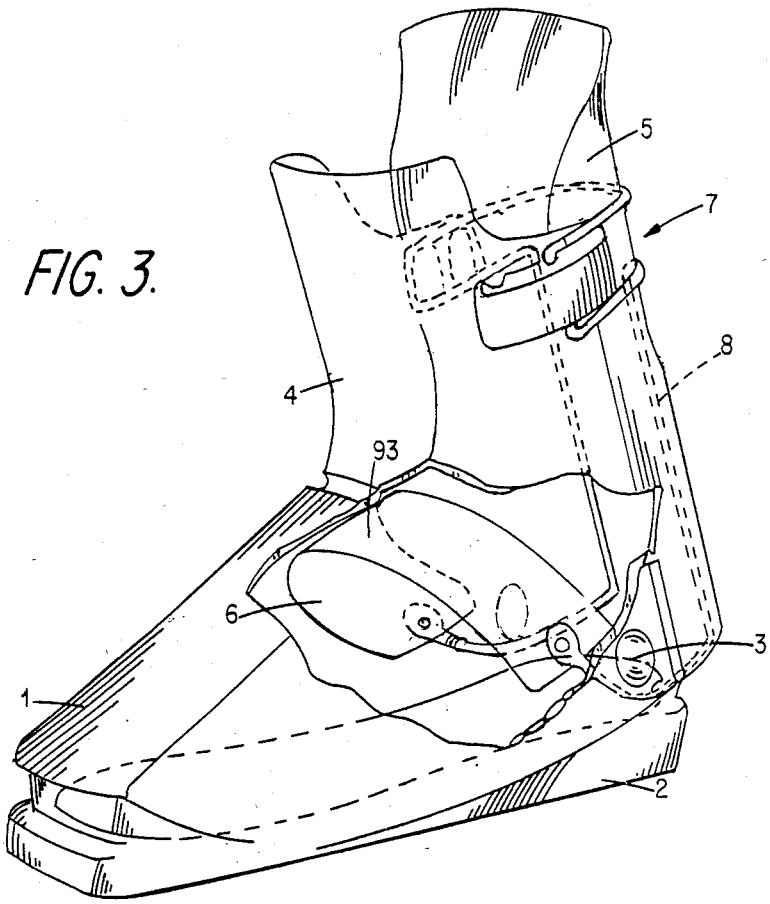
FIG. 3 illustrates, in front perspective, a third embodiment of the invention, in partial view, of the portion of the invention relating to the hold down of the foot.
Figure 4:
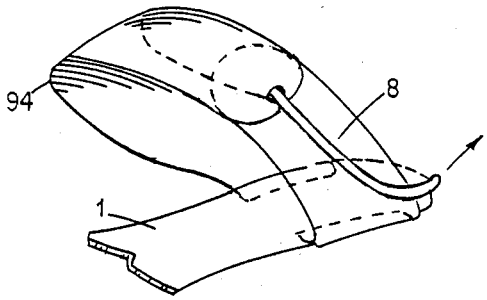
FIG. 4 shows is an alternative embodiment of the strap of FIG. 3.

FIGS. 3 and 4 illustrate alternative embodiments of the foot retention apparatus 6 where the anatomically configured shell 9, even though not absolutely necessary, may be replaced by a strap 93 (FIG. 3), or 94 (FIG. 4), distributing the contact pressure over the instep of the skier as does shell 9, but substituting itself likewise for semi-loop 810 (FIG. 1) and 820 (FIG. 2) of cable 8. In the first case, cable 8 ends in strap 93 to form a closed loop as described with reference to FIG. 1. In the second case (FIG. 4), cable 8, has its first end fixed onto the side of strap 94, itself attached to shell base 1, before passing the level of transverse axis 3 and rising the length of cuff 4, or rear spoiler 5, as desribed with reference to FIG. 2.

From the description of the preceding embodiments, it is clear that the apparatus according to the invention is much more simple to form than known apparatus. Furthermore, the inventive technique is very much more efficient since the hold down of the heel is effective and the foot and front foot portions are perfectly held, in contrast to existing apparatus which assure only enclosure of the foot. Furthermore, cable 8, by virtue of its flexibility and its latitude of displacement will position itself with respect to the foot where it is best, i.e., by mating with the surface trajectory which is shortest as a function of the morphology of the skier's foot itself, in the flexion fold, and not on the side where it could cause pain.

It should be likewise be noted that the apparatus according to the invention with a single manipulation element for the retention of the foot and the enclosure of the lower leg is, relative to the state of the art, extremely simple to manufacture and to assemble. In effect, entire cable circuit 8 can be connected to a single element: rear spoiler 5 in the embodiment of FIG. 1, cuff 4 in FIG. 2. Its definitive positioning with respect to the remainder of the boot occurs at the same time as that of rear spoiler 5 (FIG. 1), or cuff 4, which is far from the case with known devices.

Another interesting aspect of the invention resides in the fact that the apparatus having a single cable 8 for the retention of the foot and the enclosure of the lower foot allows, for a given size such as normally define, the possibility of absorbing both the variation of the short perimeter of the heel which can be on the order of 40–50 millimeters and the variation of perimeter of the lower leg which can be on the order of 50–60 millimeters. This variation for feet of the same length is easily taken into account by the two upper loops 813 and 814, or semi-loop 824 and the two cable portions 821, 825 going to the other side of the lower leg, since there is at these locations a doubling of cable 8 cooperating with a limited reasonable number of anchorage studs 42 and latching apparatus pinions 10 and 11.

In all cases, the length adjustments having been made, the manipulation of the single latching apparatus 10, by pulling on single cable 8, assures the hold down of the heel and the enclosure of the lower leg by pressing rear spoiler 5 against cuff 4.

Although the embodiments described above are quite useful, the path of the cable around the instep is relatively long and it is desirable preferable to shorten and/or simplify the cable path without reducing the retention capability in the shell base.

As shown in FIGS. 5–9, cable 8, anchored adjacent to transverse axis pin 3 (FIG. 7) or along the axis pin itself (FIGS. 5,6, 8 or 9) mounted on the instep of the skier, rests on an anatomically configured shell 9. However, intsead of descending towards the other end of axis 3 in a manner so as to surround the instep, it leaves cuff 4 through a fixed guide 41 positioned on the other side, at the level of the lower leg.

This configuration allows not only for good retention of the foot in shell 1, particularly when an anatomically configured shell 9 or a strap is utilized, but further offers the supplemental advantage of tightly pressing the foot against the lateral wall of the boot; preferably the interior lateral wall.

In the embodiment shown in FIG. 5, cable 8, at the outlet of guide 41, follows a path analogous to that of FIG. 2, forming half-loop 830 on rear spoiler 5 generally perpendicular to the axis of the leg of the skier before attachment at anchorage point 42 on the cuff 4 on the same side as fixed guide 41.

Figure 8:
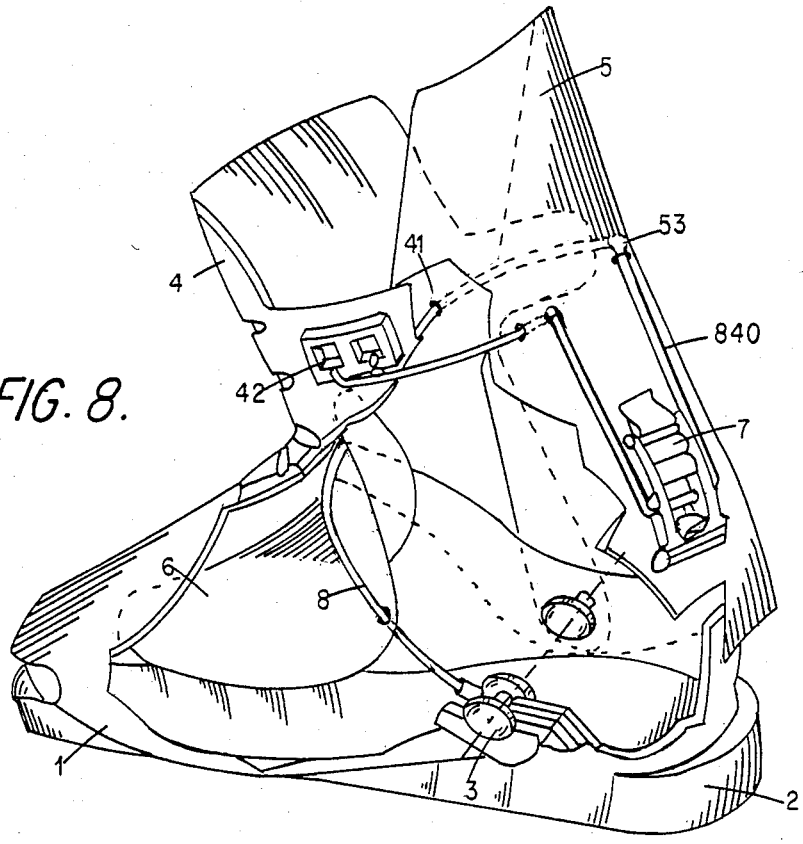
FIG. 8 is a side perspective view of yet another embodiment of the invention.
Figure 9:
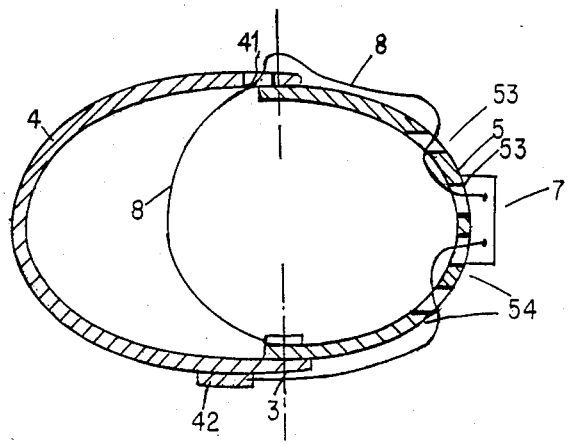
FIG. 9 illustrates a top view of the embodiment shown in FIG. 8.

In the embodiment of FIGS. 8 and 9, cable 8 at the outlet of guide 41 extends rearwardly towards rear spoiler 5, passes through at least a first guide 53 carried by the spoiler before forming a semi-loop 840 on the dorsal portion of rear spoiler 5, benearth the lower leg and generally parallel to the axis of the leg. Cable 8 thus passes through at least a second guide 54 (FIG. 9) on rear spoiler 5 which is likewise at the level of the lower leg and runs forwardly along cuff 4, until an anchorage point 42 on the side of the cuff opposite to that of fixed guide 41.

In the preceding two embodiments (FIGS. 5 and 8–9) anchorage means 42 of cable 8 on cuff 4 can be identical to those of FIGS. 2 and 4 if desired, and may be adjustable if desired. The same is true of latching closure apparatus 7 which is associated with semi-loops 830, 840 and there is, therefore, no need to repeat their construction at this juncture. However, given the path of cable 8 which is considerably simplified in the latter embodiments, it is perfectly possible to envision an automatic windup reel closure apparatus 7 which obviates the presence of hooks, pinions, or other tensioning lever means.

As previously noted, anchorage apparatus 42 of cable 8 on cuff 4 may be adjustable. The same is true of the other end of cable 8 adjacent to axis pin 3. Thus, FIG. 6 illustrates an end having an eye through which axis pin 3 extends, and is thus non-adjustable.

FIG. 7 illustrates an adjustable anchorage adjacent to axis pin 3 in which the end of cable 8 may be lodged in successive cutouts which may be provided at selected locations in shell 1.

Of course, as in the earlier embodiments, it is clear that a strap such as strap 94 may be substituted at the extreme lower end of cable 8 which distributes the contact pressure due to the traction of cable 8 over the instep of the skier.

Although the invention has been described with reference to particular means, embodiments and materials, it is to be understood that the invention is not limited to the particulars disclosed and includes all embodiments claims.

What is claimed is:

1. A rear entry ski boot comprising:

(a) an upper comprising a cuff and a rear spoiler, at least a portion of said upper being journalled on a shell base along a generally transverse axis;

(b) a foot retention apparatus positioned and configured to directly exert pressure on the foot within said shell base; and (c) a closure apparatus for closing the upper around the lower leg of the skier, said closure apparatus being connected to the foot retention apparatus by means of a traction circuit.

2. The ski boot as defined by claim 1 wherein said traction circuit is a single traction circuit adapted to both assure retention of the rear spoiler against the cuff during rearward lean, and hold down the instep.

3. The ski boot as defined by claim 2 wherein said single traction circuit comprises a single cable having a portion which at least partially surrounds the rear of the boot in the vicinity of the lower leg.

4. The ski boot as defined by claim 3 wherein said single traction cable forms a closed loop comprising a lower semi-loop extending around and over the instep of the skier, and which then extends upwardly in two portions behind the heel of the skier and rises up the rear spoiler to end in two upper lateral opposite semi-loops, each of said semi-loops being connected by a common portion, the two semi-loops ending, respectively, in at least one lateral anchorage element on the cuff, and at least one latching element cooperating with a complimentary element carried by the cuff at the level of the lower leg of the skier.

5. The ski boot as defined by claim 4 wherein each of said two portions extending from said lower semi-loop passes adjacent to said transverse axis, before turning to extend upwardly behind said heel.

6. The ski boot as defined by claim 5 wherein each of said two portions at the end of said lower semi-loop turn to extend upwardly and passes into a fixed guide behind the heel on said rear spoiler.

7. The ski boot as defined by claim 6 wherein at the lower portion of the leg, the portions extending up the rear spoiler each pass out to the exterior through a fixed guide on the upper portion of the rear spoiler.

8. The ski boot as defined by claim 4 wherein one of said upper lateral semi-loops cooperates with an anchorage apparatus on said cuff and the other of said semi-loops is associated with a latching element cooperating with a complimentary element on the cuff.

9. The ski boot as defined by claim 2 wherein said single traction circuit comprises a traction cable which forms a lower semi-loop passing over and around the instep of the skier before changing direction adjacent to said transverse axis and rising up the rear spoiler to form an upper semi-loop associated with a latching element cooperating with a compliemntary element on the cuff at the lower level of the leg and ending in a portion again passing behind the rear spoiler and attached at its end to an anchorage apparatus on said cuff.

10. The ski boot as defined by claim 2 wherein said single traction circuit comprises a cable which forms a lower semi-loop passing over and around the instep of the skier before changing direction adjacent to said transverse axis and rising up the cuff until a fixed guide on said cuff where its direction is changed to then pass behind the rear spoiler to form an upper semi-loop associated with a latching element cooperating with a complimentary element on the cuff at the lower level of the leg, and ending in a portion again passing behind the rear spoiler and attached at its end to an anchorage apparatus on said cuff.

11. The ski boot as defined by claim 2 wherein said foot retention apparatus comprises a lower semi-loop adapted to extend over and around the instep of the skier.

12. The ski boot as defined by claim 11 wherein said single traction circuit comprises a single traction cable, and wherein a portion of said cable forms said lower semi-loop, and wherein said foot retention apparatus further comprises an anatomically configured shell, said semi-loop being adapted to press said shell against said instep whereby said shell distributes pressure exerted by said semi-loop over said instep.

13. The ski boot as defined by claim 2 wherein said single traction circuit is formed of a cable connected at both its ends to a strap, said strap constituting said foot retention apparatus, said strap extending over said instep and connecting the lower ends of each of said cables, said strap distributing the contact pressure due to the traction of the cable on the instep of the skier.

14. The ski boot as defined by claim 2 wherein said single traction circuit comprises a cable connected at one of its ends to a strap within said shell base, said strap being secured at its end not attached to said cable to said shell base, said cable extending out of said shell base, and upwardly behind said rear spoiler, and ultimately being secured at its other end to said cuff, whereby tensioning of said cable by closure of said closure apparatus presses said rear spoiler against said cuff, and holds down the foot by exerting pressure on the instep.

15. The ski boot as defined by claim 2 wherein said single traction circuit comprises a cable attached at a first end to said boot at a location adjacent to said transverse journal axis, said cable passing upwardly and across the instep of the skier and leaving to the exterior of said cuff through a fixed lateral guide in said cuff on the side opposite from the attachment point, at the level of the lower leg, before forming a semi-loop associated with said closure apparatus to end in a lateral anchorage point on said cuff.

16. The ski boot as defined by claim 15 wherein said semi-loop between said fixed lateral guide and said anchorage point passes on said rear spoiler along a direction which is at least generally perpendicular to that of the leg of the skier, and wherein the anchorage point on the cuff is positioned on the same side as the fixed lateral guide.

17. The ski boot as defined by claim 16 wherein said fixed lateral guide is a first fixed guide, and wherein said cable, upon leaving said first fixed guide on said cuff, extends rearwardly along said rear spoiler to pass through a second fixed guide on said rear spoiler before forming a semi-loop on the dorsal portion of said rear spoiler extending below the lower leg and generally parallel to the axis of the leg, said cable then passing through a third fixed guide on said rear spoiler at the level of the lower leg, before extending frontwardly towards the cuff to an anchorage point positioned on the cuff.

18. The ski boot as defined by claim 17 wherein said anchorage point is positioned on said cuff on the side opposite said first fixed guide.

19. The ski boot as defined by claim 15 wherein said first end of said cable is adjustably anchored.

20. The ski boot as defined by claim 15 wherein said first end of said cable is anchored permanently and wherein said first end of said cable comprises an eye therein anchored by a transverse axis pin.

21. The ski boot as defined by claim 15 further comprising an anatomically configured shell positioned to be pressed by said cable against said instep to hold down the foot, and distribute pressure over the instep.

22. The ski boot as defined by claim 2 wherein said single traction circuit comprises a cable attached at a first end to said boot by means of a strap secured to the boot at a location adjacent to said transverse axis, said strap passing upwardly and across the instep of the skier whereat it is connected to said cable, and whereafter said cable passes to the exterior of said cuff through a fixed lateral guide in said cuff, at the level of the lower leg, on the side opposite from the attachment point of said strap to said boot, before forming a semi-loop associated with said closure apparatus to end in a lateral anchorage point on said cuff.

23. A rear entry ski boot comprising:

(a) an upper comprising two separable portions, at least one of said portions being journalled relative to the other;

(b) a foot retention apparatus within said boot being configured and positioned to directly exert pressure on the foot to hold down a foot instep to maintain the heel tightly in the boot; and (c) a closure apparatus for closing the upper around the lower leg of the skier, said closure apparatus being connected to said foot retention apparatus by means of a single traction circuit, whereby exertion of tractional force on said circuit results in simultaneous hold down of the instep and increased tightening of the enclosure of the upper around the lower leg.

24. The rear entry ski boot as defined by claim 23 wherein said single traction circuit is activatable by manipulation of a single latching element.

25. The rear entry ski boot as defined by claim 23 wherein said separable portions of said boot comprise a cuff and a rear spoiler, and wherein said latching element is positioned on the cuff.

26. The rear entry ski boot as defined by claim 23 wherein said separable portions of said boot comprise a cuff and a rear spoiler, and wherein said latching element is positioned on the rear spoiler.

27. The rear entry ski boot as defined by claim 23 wherein said separable portions of said boot comprise a cuff and a rear spoiler, and wherein said latching element is positioned to extend over said rear spoiler and cuff in the closed position.

28. The rear entry ski boot as defined by claim 23 wherein said single traction circuit comprises a semi-loop extending over the instep.

29. The rear entry ski boot as defined by claim 23 wherein said semi-loop over the instep comprises a strap.

30. The rear entry ski boot as defined by claim 23 wherein said semi-loop over the instep comprises a cable and an anatomically configured shell, said cable being adapted to press said shell against the instep.

31. The rear entry ski boot as defined by claim 23 wherein said single traction circuit comprises a cable having two ends, each of said ends not being in physical contact.

32. The rear entry ski boot as defined by claim 23 wherein said single traction circuit comprises a loop of cable having no end.

33. A rear entry ski boot comprising:

(a) an upper comprising a cuff and a rear spoiler, at least a portion of said upper being journalled on a shell base along an axis generally transverse to the longitudinal axis of said boot;

(b) a foot retention apparatus within said shell base positioned and configured to directly exert pressure on the foot; and (c) a closure apparatus for closing the upper around the lower leg of the skier, said closure apparatus being connected to the foot retention apparatus by means of a single traction circuit which both closes the upper around the lower leg of the skier and activates said foot retention apparatus to hold down the heel.

34. A rear entry ski boot comprising:

(a) an upper comprising a cuff and a rear spoiler, said upper being mounted on a shell base, said rear spoiler being pivotably mounted on said shell base to allow for rear entry of the foot, and said cuff being mounted not to pivot relative to said shell base;

(b) a foot retention apparatus positioned and configured to directly exert pressure on the foot mounted within said shell base for holding down a foot instep to maintain the heel tightly in the boot; and (c) a closure apparatus for closing the cuff and rear spoiler around the lower leg of the skier, said closure apparatus being connected to said foot retention apparatus by means of a single traction circuit, whereby exertion of tractional force on said circuit results in simultaneous hold down of the instep and increased tightening of the cuff and rear spoiler around the lower leg.

35. The rear entry ski boot as defined by claim 34 wherein said single traction circuit comprises a single cable.

36. The rear entry ski boot as defined by claim 35 wherein the single traction circuit is activatable by manipulation of a single latching element.

37. The rear entry ski boot as defined by claim 34 wherein foot retention element is secured within said shall base and applies pressure against the foot independently of the shell base.

* * * * *

UNITED STATES PATENT AND TRADEMARK OFFICE

CERTIFICATE OF CORRECTION

PATENT NO. : 4,593,483

DATED : June 10, 1986

INVENTOR(S) : Jean PARIS

It is certified that error appears in the above-identified patent and that said Letters Patent is hereby corrected as shown below:

Column 2, line 66, change "heal" to ---heel---.

Claim 9, line 5, after "up the rear spoiler" insert ---until a fixed guide and then behind the rear spoiler---.

Signed and Sealed this

First Day of September, 1987

*Attest:*

*Attesting Officer*

DONALD J. QUIGG

*Commissioner of Patents and Trademarks*